United States Patent [19]

Garnier

[11] 4,413,395

[45] Nov. 8, 1983

[54] METHOD FOR FIXING A TUBE BY EXPANSION

[75] Inventor: Andre Garnier, Berlaimont, France

[73] Assignee: Vallourec SA, Paris, France

[21] Appl. No.: 230,531

[22] Filed: Feb. 2, 1981

[30] Foreign Application Priority Data

Feb. 15, 1980 [FR] France ..... 80 03348

[51] Int. Cl.[3] ..... B21D 39/06; B21D 39/10; B23P 15/26; F16L 39/00

[52] U.S. Cl. ..... 29/157.3 C; 29/157.4; 72/123; 285/222

[58] Field of Search ..... 29/157.4, 157.5, 157.3 C, 29/523; 285/222; 72/123, 75

[56] References Cited

U.S. PATENT DOCUMENTS

| | | | |
|---|---|---|---|
| 560,919 | 5/1896 | O'Toole | 29/157.5 |
| 1,998,047 | 4/1935 | Farr | 29/523 |
| 2,292,467 | 8/1942 | Norsell | 29/523 |
| 3,534,988 | 10/1970 | Lindsey | 29/523 |
| 3,787,945 | 1/1974 | Pasek et al. | 29/157.4 |
| 3,922,768 | 12/1975 | Takayasu | 29/157.4 |

FOREIGN PATENT DOCUMENTS

| | | | |
|---|---|---|---|
| 456309 | 6/1913 | France | 285/222 |
| 24456 | of 1895 | United Kingdom | 285/222 |
| 217859 | 6/1924 | United Kingdom | 285/222 |
| 467318 | 6/1937 | United Kingdom | 285/222 |
| 518257 | 7/1976 | U.S.S.R. | 29/523 |

*Primary Examiner*—Lowell A. Larson

*Attorney, Agent, or Firm*—McDougall, Hersh & Scott

[57] ABSTRACT

A method for fixing a tube by expansion improve the seal between a tube and a support plate which are joined by expansion fixing. The method comprises forming fine annular projections on the surface of a bore which is formed in the support plates, and inserting a tube within the bore so that upon expanding the tube within the bore, the projections engage the tube to produce a seal.

4 Claims, 5 Drawing Figures

METHOD FOR FIXING A TUBE BY EXPANSION

BACKGROUND OF THE INVENTION

The present invention relates to a method for fixing a tube by expansion. Expansion tube fixing is a well known process for joining tubes to support plates. In this fixing process, a bore is formed in a plate, and the end of the tube engages the bore. The outside wall of the tube is then expanded against the inside surface of the bore in the plate by means of a tube expander comprising a plurality of rollers disposed about a tapered spindle.

It is preferred in processes for fixing a tube by expansion that grooves be machined in the inside surface of the bore to improve the connection between the tube and the plate. The grooves are usually 0.5 millimeter (mm) in depth and a few millimeters in width. This grooving process, however, can be used only for fixing thick tubes; because thin tubes, which can be less than one millimeter in thickness, have a tendency to split at the edges of the grooves. Moreover, although the grooving operation improves the interengagement between the tube and the plate, the seal thereof remains virtually unaltered.

It has also been proposed, for fixing thin tubes by an expansion process, for the inside surface of the bore to have machined therein, grooves which are smaller in depth, being for example on the order of three tenths of a millimeter in depth, and with an axial extension (or width) of the same order, that is to say, much less than the grooves used for expansion fixing of thick tubes. When the tube is expanded within the bore, a bead or fillet of metal is formed in the grooves.

This bead improves the seal between the plate and the bore. The technique described, however, has the disadvantage that the operation of machining the grooves is delicate and expensive. In addition, the engagement of the tube in the plate is such that no sliding motion is permitted. This can result in high levels of axial compression stresses in the tube if the tube is also fixed by expansion at its other end.

The present invention eliminates these disadvantages by providing an expansion-fixing method which can be used specifically for the expansion-fixing of thin tubes. The invention improves the seal between the joined components and can be performed in a simple and inexpensive manner.

SUMMARY OF THE INVENTION

The present invention relates to expansion-fixing wherein at least one bore is formed in a metal plate for receiving the end of a tube. At least one annular projection which extends beyond the inside surface of the bore is formed in the bore; each annular projection is a small axial extension relative to the thickness of the plate—the axial extension is measured parallel to the axis of the bore. Each of these fine projections is partially crushed in the expansion-fixing operation to produce a concentration of stresses and, therefore, to improve substantially the sealing effect despite the fineness of the projections.

The present invention is particularly suitable for producing condensers for use in nuclear or chemical installations where the requirement for tight seals is becoming increasingly more important. In addition, the tubes used in such condensers are often made of titanium and thus, for reasons of economy, of small thicknesses.

These two competing factors produce serious difficulties with regard to expansion-fixing of thin tubes, comprising for example titanium, in plates made of cupro-aluminum. The present invention, however, makes it possible to meet the requirement for tight seals with the use of thin tubes.

Each annular projection according to the invention has an extension of less than one millimeter as measured parallel to the axis of the tube. The projection extends radially by a small amount beyond the inside surface of the bore—not more than approximately 0.2 mm. Good results have been obtained with annular projections which extend axially over a length of 0.5 mm or even less, and which project radially between 0.03 and 0.05 mm from the inside surface of the bore.

In the preferred embodiment of the invention, the annular projections are formed by displacing material at the inside surface of the bore. This material displacement operation can advantageously be performed by an expansion operation before the end of the tube is positioned in the bore.

The present invention is also concerned with an apparatus similar to a tube expander for producing a machining on the surface of a bore similar to an annular projections by the expansion operation. According to the invention, the apparatus similar to a tube expander has an external envelope provided within an annular arrangement with recessed portions which are at least partly complementary to said annular projections to be formed on the inside surface of the bore, and raised projections which are intended to displace the material of the inside surface of the bore into said recessed portions. For example, an apparatus of this kind may be produced by replacing the conventional conical rollers by a plurality of balls. In a preferred embodiment of the invention, however, each conical roller comprises annular grooves which are complementary in shape to the projections formed in the inside surface of the bore.

Preferably, the rollers of the apparatus comprise portions which are at a level between the level of the recessed portions and the level of the raised portions, thereby to increase abruptly the expansion torque when the rollers contact the inside surface of the bore.

The present invention is also concerned with an assembly comprising at least one tube connected to a plate, the assembly being produced by the above-defined process.

DETAILED DESCRIPTION OF THE INVENTION

Figure 1:
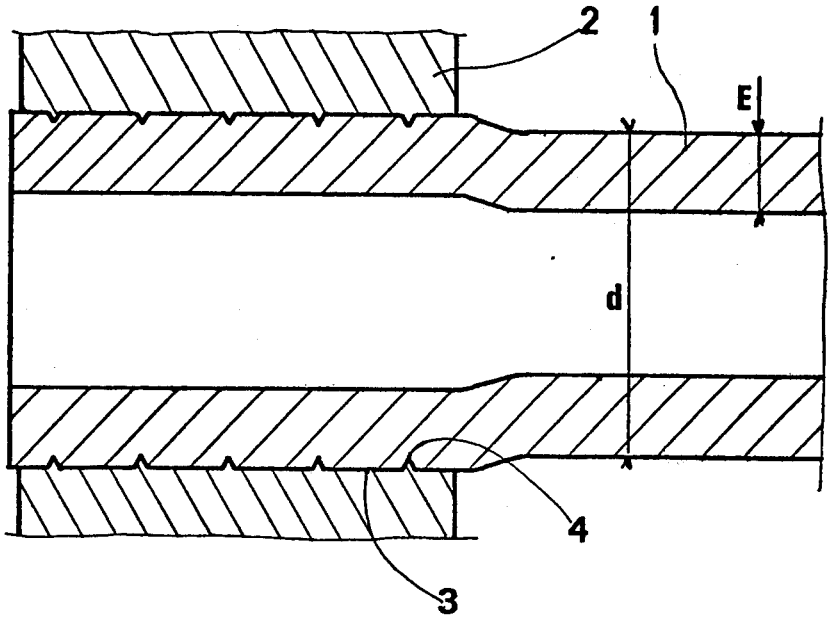
FIG. 1 is a sectional view of a tube that has been fixed by expansion in a plate according to one embodiment of the invention.

FIG. 1 illustrates a tube 1 that is fixed by expansion in a plate 2. It will be noted that for clarity and ease in understanding the drawing the thickness of the tube in each figure is markedly exaggerated relative to the tube diameter.

The tube expansion fixing operation is performed in the following manner. A bore 3 is first formed in the plate 2: the diameter of the bore is slightly greater than the outside diameter of the tube 1. Annular projections 4 are then formed in the inside surface of the bore 3 by any means known to those skilled in the art; for example, by using an apparatus similar to a tube expansion fixing tool. The projections 4 in this embodiment are substantially isosceles in cross section. The end of the tube 1 is then engaged into the bore 3 provided with the projections 4 so that the tube can be fixed by expansion in a conventional manner.

In the operation of expanding the tube to fix it in the bore, the projections 4 are crushed and this results in localized residual stresses which are substantially greater than the mean gripping stress. It has been found that this stress is sufficient to ensure a seal between the plate and the tube even when the elastic limit of the plate 2 is two thirds that of tube 1.

A single projection 4 may be sufficient, but a plurality of such projections is preferred to account for the fact that the end projections may be damaged when the tube 1 is engaged into the bore 3.

Figure 2:
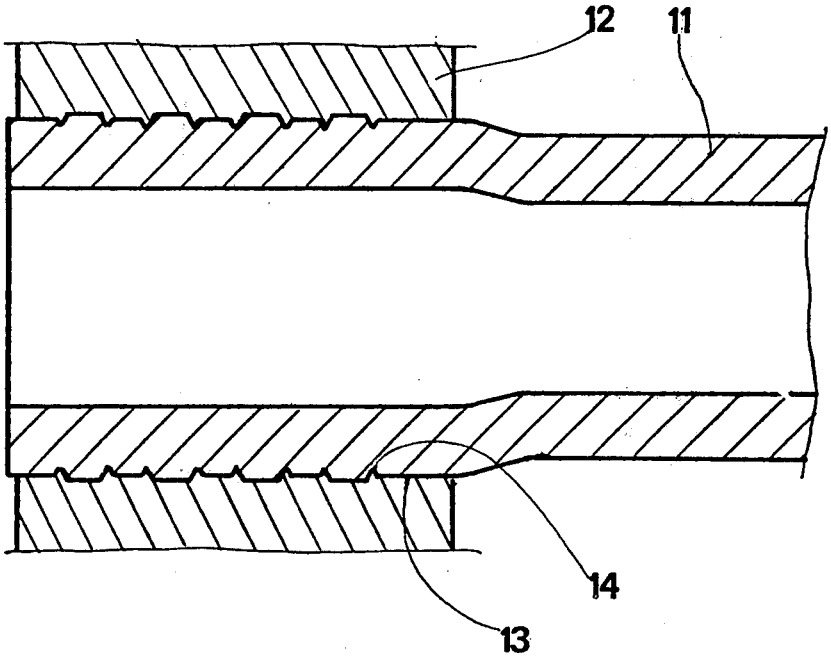
FIG. 2 is a sectional view similar to FIG. 1, showing another embodiment of the invention.
Figure 4:
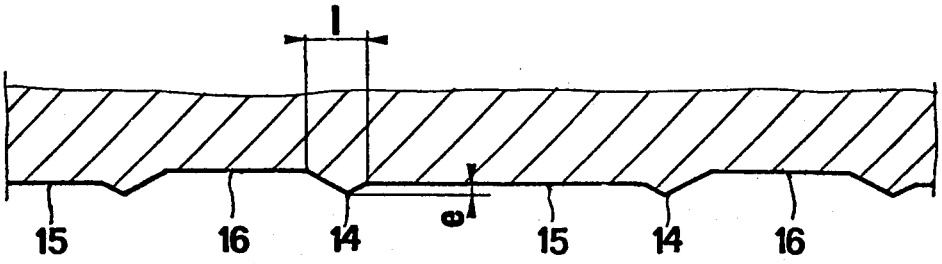
FIG. 4 is a partial sectional view of the inside surface of a bore that receives the end of a thin tube to be fixed therein by expansion.

FIGS. 2 and 4 show a second embodiment of the invention. As in FIG. 1, FIG. 2 shows a tube 11 which has been fixed by expansion in a plate 12. Prior to introducing the tube 11 into the bore 13 of the plate 12, projections 14 (shown in greater detail in FIG. 4) are formed on the inside surface of the bore 13.

The projections 14 have an axial extension I which is 0.5 mm or less. The height by which the projections extend from the surface 15 of the bore is between 0.03 and 0.05 mm. The bore 13 also comprises recessed regions 16 which are disposed alternately with the regions 15 in which the surface of the bore has not been altered.

The manner of producing the projections 14 will now be described with reference to FIG. 5. The projections 14 are formed by means of an apparatus 20 similar to a tube expander which in known manner comprises a tapered spindle 21 around which conical rollers 22 are disposed so that the external envelope of the rollers 22 is generally cylindrical.

In contrast to the rollers of the known tube expander tools, the rollers 22 of the present apparatus are machined to form recessed portions 23, which are complementary to the projections 14, and raised portions 24. In the preliminary operation of using the apparatus 20 in the plate 12 without the tube 11 therein, the raised portions 24 are capable of displacing the material on the inside surface of the bore into the recessed portions 23, to form the protrusions 14. It should be noted that the rollers 22 comprise portions 25 which are at a level between the bottom of the recessed portions 23 and the surface of the raised portions 24. Thus, when the apparatus 20 is used in the plate 12, the raised portions 24 displace the material into the recessed portions 23 and the tube expander thrusts itself into the surface of the bore until the intermediate portions 25 come into contact with the surface 15 of the bore. At that moment, the expander torque increases abruptly so that it is possible to adjust the expander tool to a given torque value, with a very high level of operating reliability.

Figure 3:
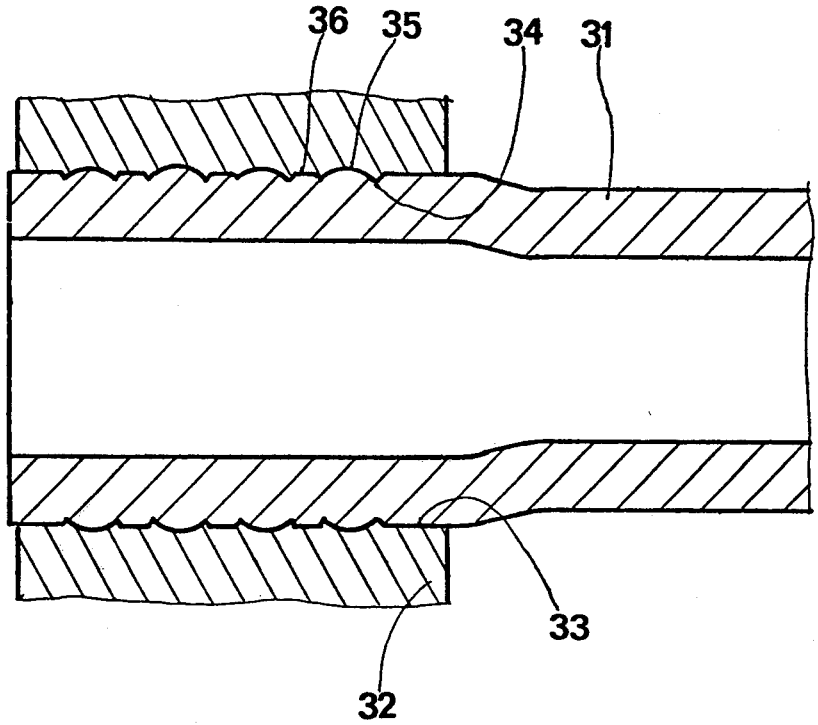
FIG. 3 is a sectional view similar to FIGS. 1 and 2, showing a third embodiment of the invention.

FIG. 3 shows another embodiment in which a tube 31 is fixed by expansion in a plate 32. In this case, the bore 33 has first been formed, without any tube 31 therein, by means of an expander tool in which the rollers were replaced by a plurality of balls. This results in projections 34 which are separated by toric depressions 35. The depressions 35 alternate with regions 36 that correspond to the original surface of the bore.

Figure 5:
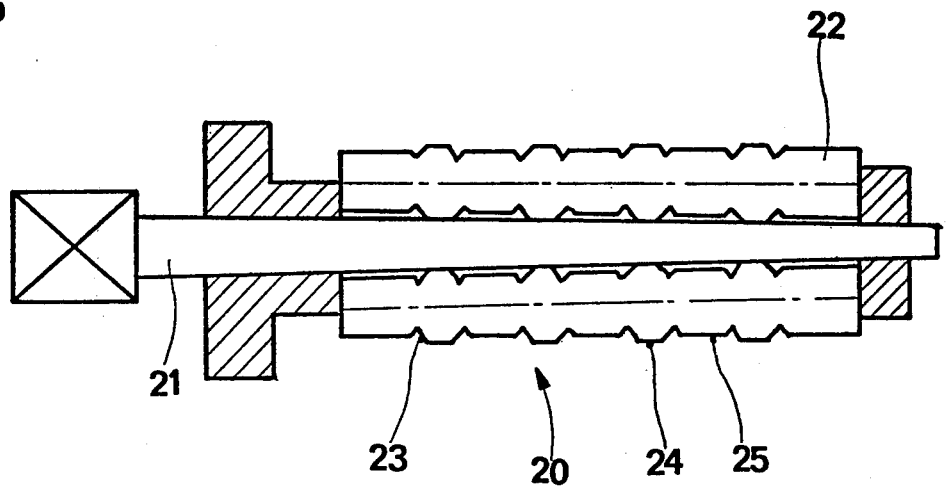
FIG. 5 shows an apparatus similar to a tube expander capable of being used in the process according to the invention.

The design shown in FIG. 5 with machined rollers, however, is preferable to forming the tool by replacing the rollers by balls, because by providing sufficiently wide raised portions 24, the bearing area of the raised portions is increased to reduce the wear on the spindle 21 of the tool.

It will be understood that the overall machining tolerances are the same as under the conditions of conventional tube expansion fixing processes. It is sufficient to provide a minimum clearance between the tube and the original bore that is greater than the normal clearance by twice the thickness of the projections. For example, if the height of the projections is 0.05 mm, the additional clearance will have to be 0.10 mm.

An essential factor of the present invention is that the projections form an axial extension that is sufficiently small for the projections to be crushed in the tube expansion fixing operation and to thereby act as sealing joints.

EXAMPLE

Tubes 1, 11 and 31 as illustrated in FIGS. 1, 2 and 3, respectively, were made of stainless steel and titanium, and had an outside diameter d and a wall thickness E of 19 mm and between 0.4 and 0.5 mm, respectively. In addition, stainless steel tubes were made of stainless steel and had an outside diameter d of 32 mm and a wall thickness E of 0.25 mm. Each of the described tubes were fixed by expansion in support plates comprising steel, aluminum, bronze and cupro-aluminum. Two fine annular projections formed according to the present invention were sufficient to produce a tight seal without excessive deformation of the metal.

It will be appreciated that various modifications may be made in the subject matter described without departing from the scope of the present invention and that shapes of projections other than those described may be used.

I claim:

1. A method for fixing a thin tube by expansion, the tube having an outside diameter from about 19 to 32 mm, comprising:

(a) forming at least one bore in a metal plate to receive the tube, the inside surface of said bore having at least one annular projection with an axial length not greater than 1 mm when measured parallel to the axis of the bore, the annular projections being formed by displacing material on the bore surface before the end of the tube is set in position in the bore;

(b) inserting the tube, which has a wall thickness from about 0.25 to 0.50 mm and said outside diameter being less than the inside diameter of the bore, into said bore; and (c) forcing the outer surface of the tube against the inside surface of the bore so that the annular projections are crushed on the inside surface of the bore to sealingly engage the outer surface of the tube.

2. A method according to claim 1 in which each annular projection is formed to extend radially not more than 0.2 millimeter from the inside surface of the bore.

3. A method according to claim 1 in which said annular projections are formed to have an axial length not more than 0.5 millimeter.

4. A method according to claim 1 in which said annular projections are formed to extend radially between 0.03 and 0.05 millimeters from the inside surface of the bore.

* * * * *